US010343816B2

(12) United States Patent
Liu et al.

(10) Patent No.: US 10,343,816 B2
(45) Date of Patent: Jul. 9, 2019

(54) PALLET

(71) Applicant: Wuhan China Star Optoelectronics Technology Co., Ltd., Wuhan, Hubei (CN)

(72) Inventors: Zhongjie Liu, Guangdong (CN); Liang Yue, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 173 days.

(21) Appl. No.: 15/544,007

(22) PCT Filed: May 25, 2017

(86) PCT No.: PCT/CN2017/085972
§ 371 (c)(1),
(2) Date: Jul. 16, 2017

(87) PCT Pub. No.: WO2018/196080
PCT Pub. Date: Nov. 1, 2018

(65) Prior Publication Data

US 2018/0334285 A1 Nov. 22, 2018

(30) Foreign Application Priority Data

Apr. 28, 2017 (CN) ..... 2017 1 0296922

(51) Int. Cl.
*B65D 19/38* (2006.01)
*B65D 19/00* (2006.01)

(52) U.S. Cl.
CPC ..... *B65D 19/38* (2013.01); *B65D 19/0077* (2013.01); *B65D 19/0095* (2013.01);
(Continued)

(58) Field of Classification Search
CPC ..... B65D 19/38; B65D 19/0077; B65D 19/0095; B65D 2519/00273;
(Continued)

(56) References Cited

U.S. PATENT DOCUMENTS 2,739,776 A 3/1956 Terando
2,934,384 A * 4/1960 Sloyan ..... F16M 7/00 248/657
(Continued)

FOREIGN PATENT DOCUMENTS

CN 201604855 U 10/2010
CN 202499345 U 10/2012
(Continued)

OTHER PUBLICATIONS

CN 107467888 abstract and figures (Year: 2017).*

*Primary Examiner* — Janet M Wilkens
(74) *Attorney, Agent, or Firm* — Andrew C. Cheng

(57) ABSTRACT

A pallet includes a main extension member and support members. The main extension member includes a rotary sleeve and two threaded bars, which are respectively inserted into the rotary sleeve through two ends of the rotary sleeve to be connected in a rotatable manner through threading engagement. The support members each include first and second support elements pivoted to each other. An end of each threaded bar that is distant from the rotary sleeve is pivotally connected to the pivotal connection between the first and second support elements. Rotation of the rotary sleeve allows for adjustment of a distance between the two threaded bars to change a bending condition therebetween so as to vary a size of the pallet. The variation of the size of the pallet is thus made flexible to suit the need for transportation of products of various sizes and thus saving costs of transportation and storage.

19 Claims, 6 Drawing Sheets

(52) U.S. Cl.
CPC ..... *B65D 2519/00273* (2013.01); *B65D 2519/00293* (2013.01); *B65D 2519/00323* (2013.01); *B65D 2519/00333* (2013.01); *B65D 2519/00572* (2013.01); *B65D 2519/00761* (2013.01); *B65D 2519/00796* (2013.01)

(58) Field of Classification Search
CPC ..... B65D 2519/00293; B65D 2519/00323; B65D 2519/00333; B65D 2519/00572; B65D 2519/00761; B65D 2519/00796; F16M 7/00; F16M 11/20
USPC ..... 108/54.1; 248/346.02, 633, 188.1; 206/386, 599, 600
See application file for complete search history.

(56) References Cited

U.S. PATENT DOCUMENTS 3,017,226 A * 1/1962 Sloyan ..... F16H 7/14 248/657
3,267,884 A * 8/1966 Lessheim ..... B65D 19/0069 108/54.1
3,695,187 A 10/1972 Weiss
3,977,333 A 8/1976 Phillips
4,120,210 A * 10/1978 Sloyan ..... F16M 7/00 248/657
5,870,958 A * 2/1999 Suzuki ..... B65D 19/0069 108/51.11
8,910,917 B1 * 12/2014 Bees ..... F16M 7/00 248/657

FOREIGN PATENT DOCUMENTS

CN 103038139 A 4/2013
CN 203033069 U 7/2013
CN 104229261 A 12/2014
CN 104495010 A 4/2015
CN 204726818 U 10/2015
CN 205854793 U 1/2017
CN 106477137 A 3/2017
FR 2629055 * 9/1989
FR 2674504 A1 10/1992
JP 04-114860 A 4/1992
WO 9616872 * 6/1996

* cited by examiner

PALLET

CROSS REFERENCE TO RELATED APPLICATIONS

This application claims the priority of Chinese Patent Application No. 2017102969225 filed on Apr. 28, 2017, titled "Pallet", the disclosure of which is incorporated herein by reference in its entirety.

BACKGROUND OF THE INVENTION

1. Field of the Invention

The present invention relates to the technical field of cargo transportation, and more particularly to a pallet.

2. The Related Arts

For easy warehouse management and cargo transportation and logistics, cargo is often carried and supported by a pallet and the cargo may be transported and stored through moving cargo by a forklift. Pallets that have been commonly used are generally made of materials including bonded wood boards, solid wood boards, plastics, and metals and are often made in the form involving strips arranged parallel to each other for easy manufacture. However, the size of a pallet, once manufactured, is not changeable and for different products and different ways of stacking, pallets of a fixed size are surely not fit to the needs of shipping of products of various sizes. For example, in a workshop that manufactures liquid crystal displays, a pallet made according to a specific size may match liquid crystal modules having a particular lengthwise dimension; however, in practical applications of usages, in consideration of matchability and reliability of product stacking, it is necessary to use pallets of different sizes to match the size of the liquid crystal modules. When the liquid crystal modules are stacked in different ways, pallets having different design sizes corresponding thereto must be used. This is disadvantageous to improving utilization of pallets in practical applications.

SUMMARY OF THE INVENTION

The technical issue for which the present invention is made is to provide a pallet, which helps overcome the problem that the known pallets having a fixed size do not suit the need for transportation of products of different sizes.

To resolve the above issue, the present invention provides a pallet. The pallet comprises main extension members and support members, wherein the main extension members each comprise a rotary sleeve and a pair of threaded bars, the pair of threaded bars being respectively inserted into the rotary sleeve through two ends of the rotary sleeve, the threaded bars and the rotary sleeve being connected in a rotatable manner through threading engagement therebetween, the support members each comprising a first support element and a second support element pivoted to each other, an end of each of the threaded bars that is distant from the rotary sleeve being pivotally connected to the pivotal connection between the first support element and the second support element corresponding thereto such that rotation of the rotary sleeve adjusts a distance between the pair of threaded bars to change a relative bending condition between the first support element and the second support element thereby varying a size of the pallet.

In the above pallet, the number of the main extension members is two and the two main extension members are arranged to intersect each other, each of the main extension members being connected to one pair of the support members, and wherein when the pallet is in a non-contracted condition, two pairs of the support members collectively define a circumferentially enclosed configuration.

In the above pallet, the pallet further comprises auxiliary extension members, the auxiliary extension members being arranged one pair of the support members connected to the main extension members, the auxiliary extension members each having two ends respectively pivoted to one pair of the first support elements or one pair of the second support elements.

In the above pallet, the number of the auxiliary extension members is plural and the auxiliary extension members are symmetrically arranged on two opposite sides of the main extension members.

In the above pallet, the auxiliary extension members each comprise one pair of straight bars and a sleeve fit over the pair of straight bars, the pair of straight bars being connected to each other through an elastic member, the straight bars having ends distant from the sleeve being pivoted to the support members.

In the above pallet, an end of the first support element connected to the second support element is provided with a first rotation axle, and an end of the second support element connected to the first support element is provided with a second rotation axle that is hollowed, the second rotation axle being fit over the first rotation axle, the first rotation axle having an outer circumferential surface on which a plurality of projections are formed, the second rotation axle having an inner circumferential surface in which a plurality of recesses is formed, the projections and the recesses being engageable with each other to selectively set and fix a relative position between the first support element and the second support element.

In the above pallet, the number of the main extension members is two and the two main extension members are arranged to intersect each other, each of the main extension members being connected to one pair of the support members, and wherein when the pallet is in a non-contracted condition, two pairs of the support members collectively define a circumferentially enclosed configuration.

In the above pallet, the pallet further comprises auxiliary extension members, the auxiliary extension members being arranged one pair of the support members connected to the main extension members, the auxiliary extension members each having two ends respectively pivoted to one pair of the first support elements or one pair of the second support elements.

In the above pallet, the number of the auxiliary extension members is plural and the auxiliary extension members are symmetrically arranged on two opposite sides of the main extension members.

In the above pallet, the main extension members each further comprise an elastic member, the elastic member being received in the rotary sleeve, the pair of threaded bars being connected to each other by the elastic member.

In the above pallet, the number of the main extension members is two and the two main extension members are arranged to intersect each other, each of the main extension members being connected to one pair of the support members, and wherein when the pallet is in a non-contracted condition, two pairs of the support members collectively define a circumferentially enclosed configuration.

In the above pallet, the pallet further comprises auxiliary extension members, the auxiliary extension members being arranged one pair of the support members connected to the main extension members, the auxiliary extension members each having two ends respectively pivoted to one pair of the first support elements or one pair of the second support elements.

In the above pallet, the number of the auxiliary extension members is plural and the auxiliary extension members are symmetrically arranged on two opposite sides of the main extension members.

In the above pallet, the rotary sleeve has an inner wall that is provided with at least two threaded plugs, the threaded plugs being fixed to the inner wall of the rotary sleeve, the threaded bars being respectively inserted into the threaded plugs and forming threading engagement with the threaded plugs.

In the above pallet, the number of the main extension members is two and the two main extension members are arranged to intersect each other, each of the main extension members being connected to one pair of the support members, and wherein when the pallet is in a non-contracted condition, two pairs of the support members collectively define a circumferentially enclosed configuration.

In the above pallet, the pallet further comprises auxiliary extension members, the auxiliary extension members being arranged one pair of the support members connected to the main extension members, the auxiliary extension members each having two ends respectively pivoted to one pair of the first support elements or one pair of the second support elements.

In the above pallet, the number of the auxiliary extension members is plural and the auxiliary extension members are symmetrically arranged on two opposite sides of the main extension members.

In the above pallet, the threaded bars are each of a hollowed structure to reduce weight of the pallet.

In the above pallet, the support members each comprise a first layer and a second layer fixedly connected to each other, the first layer and the second layer being stacked on each other such that a gap is formed between the first layer and the second layer for receiving insertion of a fork of a forklift.

The efficacy of the present invention is as follows. Rotation of a rotary sleeve allows for adjustment of the distance between a pair of threaded bars and varies a length of a main extension member. Two ends of the main extension member are each connected to one of the support members. Each of the support members comprises a first support element and a second support element pivoted to each other. The main extension member is connected to the pivotal connection between the first support element and the second support element. Thus, adjusting the length of the main extension member changes a bending or inclining condition between the first support element and the second support element so as to change a size of the pallet, allowing for flexible variation of the size of the pallet to suit the need for transportation of cargo of different sizes and thus reducing costs of transportation and storage.

BRIEF DESCRIPTION OF THE DRAWINGS

To more clearly explain the technical solution proposed in an embodiment of the present invention and that of the prior art, a brief description to the drawings that are necessary for describing the embodiment or the prior art is given as follows. It is obvious that the drawings that will be described below show only some embodiments of this application. For those having ordinary skills of the art, other obvious variations may be readily available from these attached drawings without the expense of creative effort and endeavor.

DETAILED DESCRIPTION OF THE PREFERRED EMBODIMENTS

A clear and complete description will be given to technical solutions provided by embodiments of the present invention with reference to the attached drawings of the embodiments of the present invention. However, the embodiments so described are only some, but not all, of the embodiments of the present invention. Other embodiments that are available to those having ordinary skills of the art without the expense of creative effort and endeavor are considered belonging to the scope of protection of the present invention.

The embodiments of the present invention provide pallets for carrying cargo in order to ease transportation and storage of cargo. In an embodiment, the pallet is used to carry display modules and the likes in a liquid crystal display manufacturing workshop.

Figure 1:
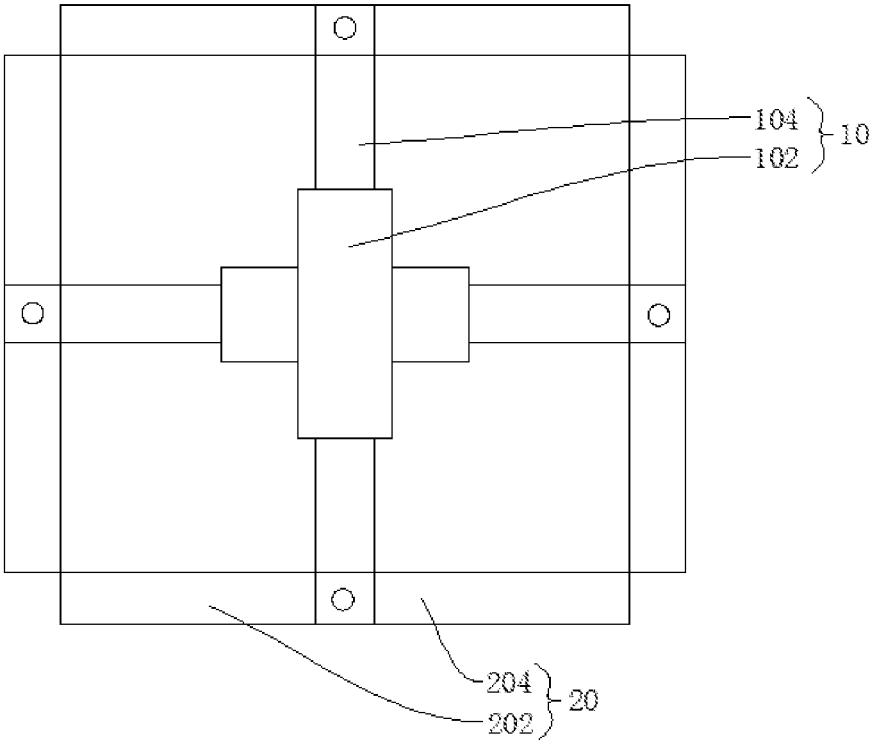
FIG. 1 is a schematic view illustrating a structure of a pallet provided in a first embodiment of the present invention in a non-contracted condition.
Figure 2:
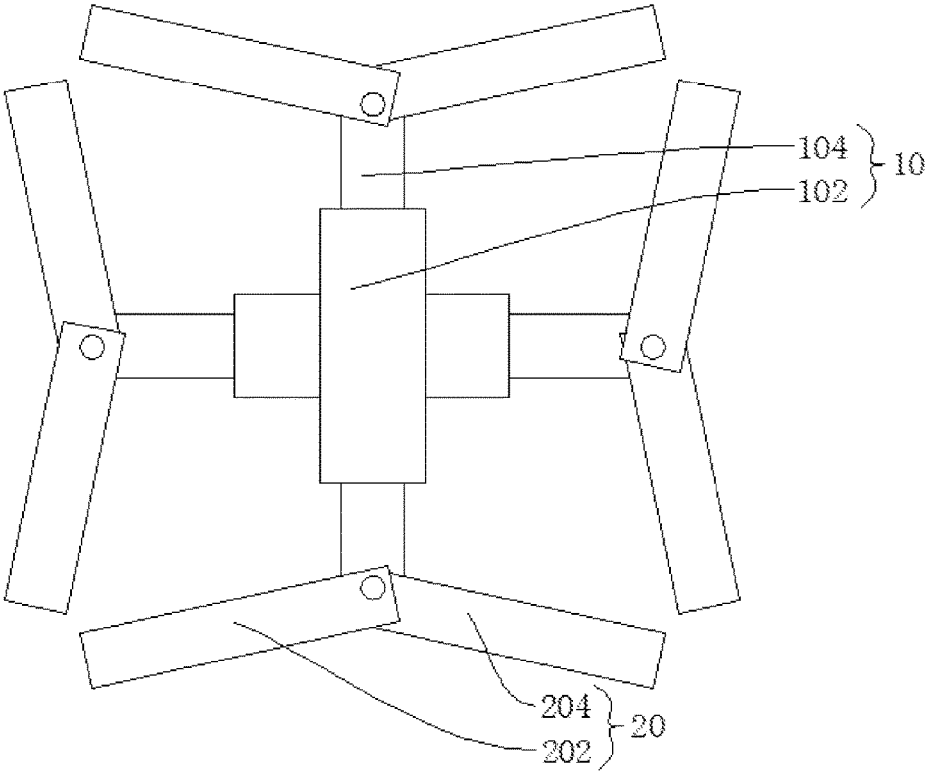
FIG. 2 is a schematic view illustrating a structure of the pallet provided in the first embodiment of the present invention in a contracted condition.
Figure 3:
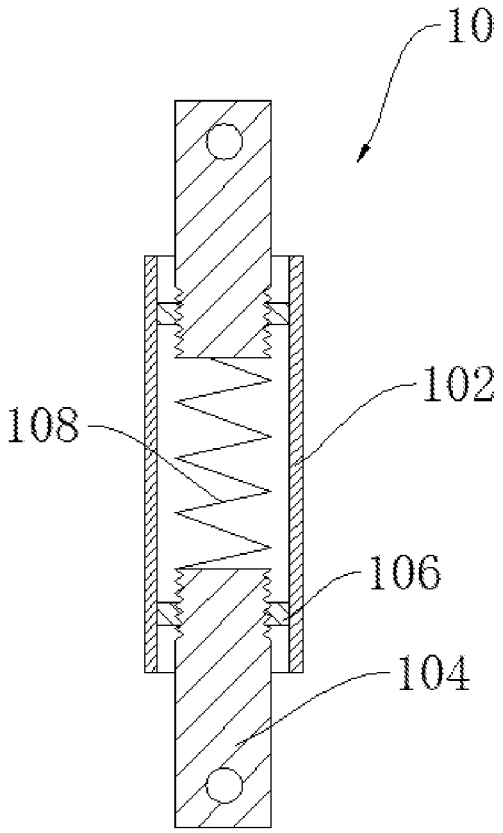
FIG. 3 is a schematic view illustrating a cross-section of a main extension member of the pallet provided in the first embodiment of the present invention.

Referring to FIGS. 1 and 2, an embodiment of the present invention provides a pallet, which comprises main extension members 10 and support members 20. Specifically, the main extension members 10, as a whole, are each made in the form of a rod-like structure. The main extension members 10 each have two ends each connected to one of the support members 20, so that through adjustment of a length of the main extension member 10, a distance between the two support members 20 can be varied. Reference being made in combination with FIG. 3, in the instant embodiment, the main extension members 10 each comprise a rotary sleeve 102 and a pair of threaded bars 104. The pair of threaded bars 104 is respectively inserted into the rotary sleeve 102 through two ends of the rotary sleeve 102. In other words, the rotary sleeve 102 is fit over the pair of threaded bars 104, or the pair of threaded bars 104 is received in the sleeve 302. Specifically, the two threaded bars 104 are respectively inserted into the rotary sleeve 102 from the two ends of the rotary sleeve 102, such that each threaded bar 104 is at least partly received in the rotary sleeve 102. Further, the threaded bars 104 and the rotary sleeve 102 are connected in a rotatable manner through threading engagement. In a preferred embodiment, end parts of the threaded bars 104 that are received in the rotary sleeve 102 have a surface on which an external thread is formed and the rotary sleeve 102 has an inner wall that is provided with at least two threaded plug 106, wherein the threaded plugs 106 are fixed to the inner wall of the rotary sleeve 102. The threaded bars 104 are inserted into the threaded plugs 106, and the external threads of the threaded bar 104 mate internal threads respectively formed in the threaded plugs 106 such that the threaded bars 104 and the rotary sleeve 102 are rotatably connected. In other embodiments, the end parts of the threaded bars 104 received in the rotary sleeve 102 each have a surface on which an external thread is formed and the rotary sleeve 102 is provided with an internal thread on an inner wall thereof at a location adjacent to each of the two ends thereof so that the external threads of the threaded bars 104 mate and engage the internal threads of the rotary sleeve 102 respectively to provide rotatable connection between the threaded bar 104 and the rotary sleeve 102. Since the threaded bars 104 and the rotary sleeve 102 are connected through threading engagement, rotation of the threaded bar 104 about a central axis is restrained, and rotating the rotary sleeve 102 manually or by means of a driving member causes a relative position between each of the threaded bars 104 and the rotary sleeve 102 to change thereby increasing or decreasing a distance between the two threaded bars 104 and thus adjusting the length of the main extension member 10.

The support members 20 each comprise a first support element 202 and a second support element 204 pivoted to each other. In other words, an end of the first support element 202 and an end of the second support element 204 are connected to each other and the first support element 202 and the second support element 204 are rotatable with respect to each other by means of the connection. In a preferred embodiment, the support members 20 are each made in the form of a rod-like structure having a flat surface. Since the surfaces of the support members 20 are provided to support cargo thereon, flatness of the surfaces helps stably support the cargo thereon. Further, an end of each the threaded bars 104 that is distant from the rotary sleeve 102 is pivoted to the pivotal connection between the first support element 202 and the second support element 204. In other words, the threaded bar 104 is rotatable relative to the first support element 202 and the second support element 204. In the instant embodiment, the threaded bars 104 each have one end that is provided with a thread connected to and received in an interior of the rotary sleeve 102 and an opposite end connected to one of the support members 20, so that when the rotary sleeve 102 is rotated to cause the threaded bars 104 to move in such a direction as being further received into the rotary sleeve 102, the threaded bars 104 pull the support members 20 to move in such a direction as further approaching the rotary sleeve 102. Further, since the threaded bars 104 are each pivoted to the pivotal connection between the first support element 202 and the second support element 204 corresponding thereto, during the process of the support members 20 approaching the rotary sleeve 102, the first support element 202 and the second support element 204 are inclined and becoming bent with respect to each other so that the pivotal connection between the first support element 202 and the second support element 204 gets approaching and thus closer to the rotary sleeve 102. Since the two ends of each of the main extension members 10 are each connected to one of the support members 20, when the threaded bars 104 are moved in such a direction as being further received into the rotary sleeve 102, the pivotal connections of the two sets of first support element 202 and second support element 204 are moved closer to each other thereby reducing the distance between the two support members 20 and thus varying the size of the pallet.

Rotation of the rotary sleeve 102 allows for adjusting the distance between the pair of threaded bars 104 and thus varying the length of the main extension member 10. The two ends of the main extension member 10 are each connected to one of the support members 20, and each of the support members 20 comprises the first support element 202 and the second support element 204 that are pivoted to each other. The main extension member 10 is connected to the pivotal connection between the first support element 202 and the second support element 204 so that adjusting the length of the main extension member 10 would change a bending state between the first support element 202 and the second support element 204 so as to vary the size of the pallet. The size of the pallet is thus variable in a flexible manner in order to suit the need for transportation of products of various sizes thereby saving costs of transportation and storage.

In the instant embodiment, the number of the main extension members 10 involved is two and the two main extension members 10 are arranged to intersect each other. Specifically, the two main extension members 10 are stacked on each other. In a preferred embodiment, the intersection between the two main extension members 10 is set at a location corresponding to a middle point of each of the main extension members 10 and the two main extension members 10 are substantially perpendicular to each other. Each of the main extension members 10 is connected to one pair of support members 20, namely contraction and extension of each of the main extension members 10 controlling variation of the spacing distance between one pair of support members 20. When the pallet is in a non-contracted condition, two pairs of support members 20 collectively form a circumferentially enclosed configuration. In a preferred embodiment, the two main extension members 10 have the same length and the support members 20 in the non-contracted condition define and circumferentially enclose a rectangular configuration. The rectangular configuration of the pallet helps stably support products thereon. The two main extension members 10 are arranged to intersect each other and the two pairs of support members 20 simultaneously receives and supports cargo thereon to provide an increased contact area between the pallet and the cargo, thereby improving stability of cargo supported on the pallet and helping prevent the cargo from sliding off the pallet during transportation.

Figure 4:
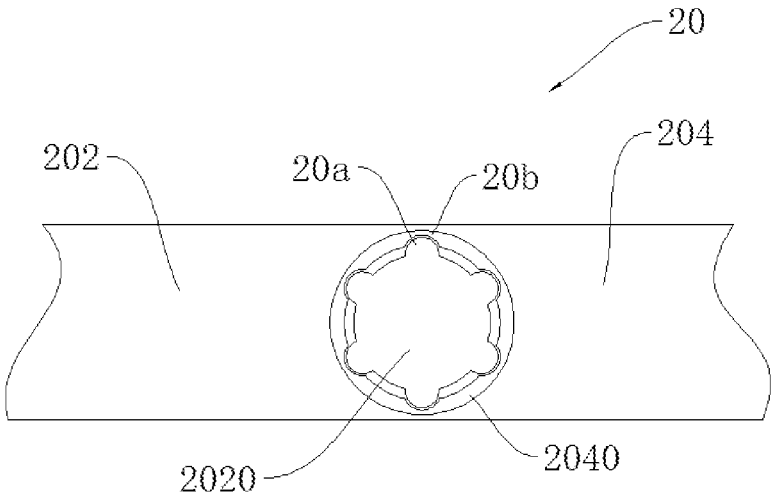
FIG. 4 is a schematic view illustrating a hinged connection of a support member of the pallet provided in the first embodiment of the present invention.

In the instant embodiment, reference being made in combination with FIG. 4, the end of the first support element 202 that is connected to the second support element 204 is provided with a first rotation axle 2020, and the end of the second support element 204 that is connected to he first support element 202 is provided with a second rotation axle 2040, which is hollowed. The second rotation axle 2040 is sleeved over the first rotation axle 2020 in such a way that the first support element 202 and the second support element 204 are allowed to rotate with respect to each other, namely forming a rotatable or pivotal connection. Further, the first rotation axle 2020 has an outside circumferential surface on which a plurality of projections 20*a* are formed, and the second rotation axle 2040 has an inside circumferential surface in which a plurality of recesses 20*b* is formed such that the projections 20*a* and the recesses 20*b* are engageable with each other for selectively setting and fixing a relative angular position between the first support element 202 and the second support element 204. Specifically, when the projections 20*a* of the first rotation axle 2020 get received into and engage with the recesses 20*b* of the second rotation axle 2040, the engagement between the projections 20*a* and the recesses 20*b* may retain, to some extents of being securely fixed, the relative position between the first support element 202 and the second support element 204 thereby fixing the configuration of the pallet to prevent the configuration or shape of the pallet from undesirably changing due to influence of external factors, such as bumping transportation process; and when an external force is applied to cause the first support element 202 and the second support element 204 to bend or incline with respect each other to a predetermined extent, for example the rotary sleeve 102 being forcibly rotated through a manual operation or by means of a driving device, the engagement between the projections 20*a* and the recesses 20*b* may not be strong enough to further retain the configuration of the support members 20 and thus, the first support element 202 and the second support element 204 become further bend or incline with respect to each other thereby adjusting the configuration of the pallet to suit for the need of transportation of cargo of different sizes.

In the instant embodiment, the main extension members 10 each further comprise an elastic member 108. The elastic member 108 is received in the rotary sleeve 102 and the threaded bars 104 are connected to each other by the elastic member 108. In a working condition, the elastic member 108 is kept in a compressed state or expanded state in order to maintain the threading engagement between the threaded bars 104 and the rotary sleeve 102 and prevent the threaded bars 104 and the rotary sleeve 102 from causing relative rotation between the threaded bars 104 and the rotary bar before a user starts rotating the rotary bar so that structure stability of the pallet in a fixed state can be improved.

In the instant embodiment, the threaded bar 104 is of a hollowed structure to help reduce the weight of the pallet.

Figure 5:
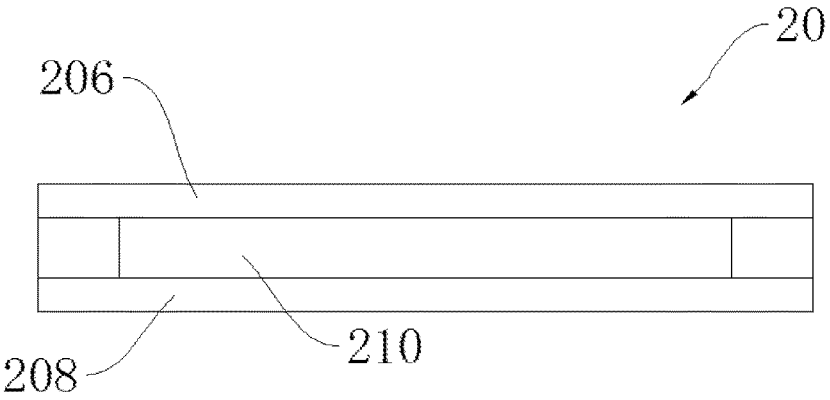
FIG. 5 is a side-elevational view illustrating a structure of the support member of the pallet provided in the first embodiment of the present invention.

In the instant embodiment, reference being made in combination with FIG. 5, the support members 20 each comprise a first layer 206 and a second layer 208 that are fixedly connected. The first layer 206 and the second layer 208 are arranged to stack on each other such that a gap 210 is formed between the first layer 206 and the second layer 208 for receiving a fork of a forklift to insert therein. In a preferred embodiment, a surface of the first layer 206 that is distant from the second layer 208 is provided for supporting cargo thereon and the surface is a flat surface to help support the cargo thereon. Further, the first layer 206 of the first support element 202 and the first layer 206 of the second support element 204 are in line with each other to provide a jointed, smooth flat surface for supporting cargo thereon to help improve stability of cargo during transportation and storage.

Rotation of the rotary sleeve 102 may adjust the distance between the pair of threaded bars 104 and thus varies the length of the main extension member 10. The two ends of the main extension member 10 are each connected to one of the support members 20 and the support members 20 each comprise a first support element 202 and a second support element 204 rotatably or pivotally connected to each other, with the main extension member 10 being connected to the pivotal connection between the first support element 202 and the second support element 204, so that adjusting the length of the main extension member 10 would change an inclined or bending state between the first support element 202 and the second support element 204 so as to change the size of the pallet, allowing for flexible variation of the size of the pallet to suit the need for transportation of products of different sizes and reducing costs of transportation and storage.

Figure 6:
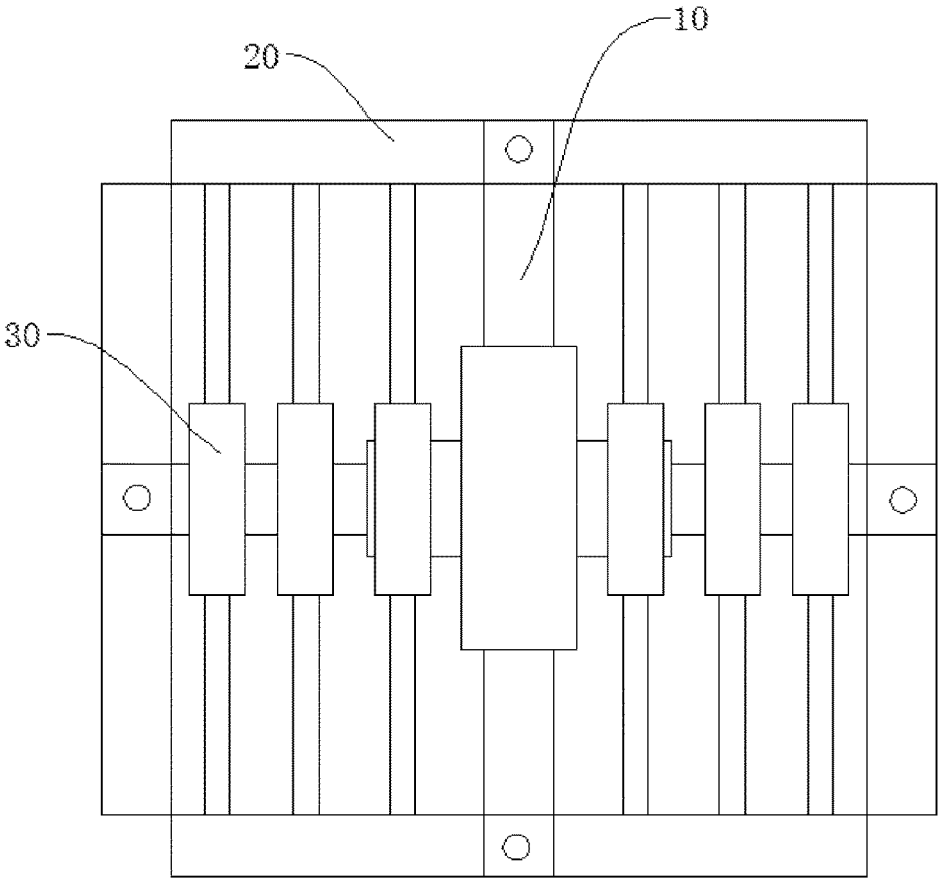
FIG. 6 is a schematic view illustrating a structure of a pallet provided in a second embodiment of the present invention in a non-contracted condition.
Figure 7:
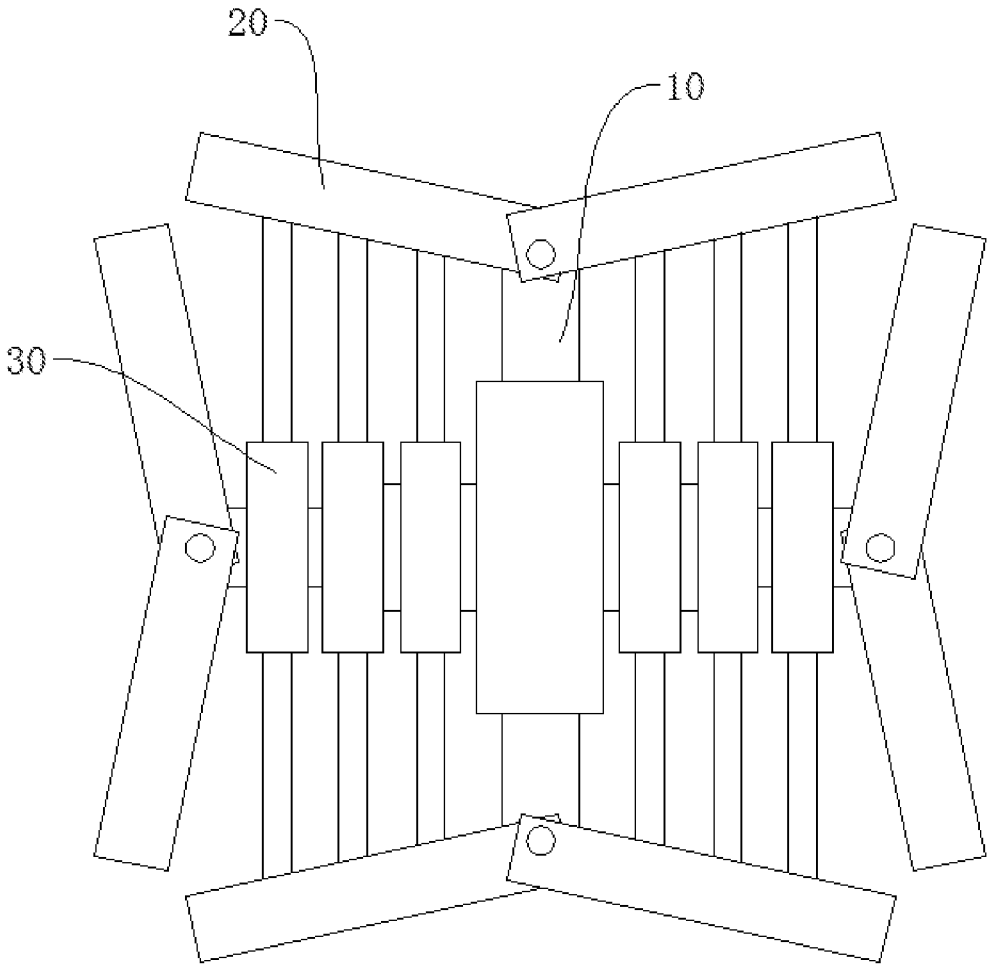
FIG. 7 is a schematic view illustrating a structure of the pallet provided in the second embodiment of the present invention in a contracted condition.

Referring to FIGS. 6 and 7, a second embodiment of the present invention provides a pallet and is different from the first embodiment in that the pallet further comprises auxiliary extension members 30. The auxiliary extension members 30 are arranged between one pair of the support members 20 that are connected by one main extension member 10 and the auxiliary extension members 30 each have two ends respectively pivoted to one pair of first support elements 202 or one pair of second support elements 204. Specifically, the auxiliary extension members 30 are "passive" extendible/contractible members and length of the auxiliary extension members 30 is determined by the support members 20 that are connected to the two ends of the auxiliary extension members 30. When the support members 20 are driven by the main extension members 10 to approach each other, the auxiliary extension members 30 are compressed by the support members 20 to get shortened. In other words, the length of the auxiliary extension members 30 is variable in accordance with the length of the main extension member 10. Further, the auxiliary extension members 30 are connected between one pair of corresponding first support elements 202 or one pair of corresponding second support elements 204. In the pallet, the auxiliary extension members 30 provide an effect of supporting or holding the pallet. Specifically, the auxiliary extension members 30 provide assistance in adjusting the distance between the support members 20 at the two ends of the main extension member 10. The main extension member 10 is operable to pull the support members 20 at the two ends of the main extension member 10 to get closer to each other and thus making the first support element 202 and the second support element 204 to bend or inclined with respect to each other so that the pivotal connections of two pairs of the first support element 202 and the second support element 204 are brought closer to each other and the distance between one pair of first support elements 202 at ends thereof that are distant from the pivotal connection is greater than that at the pivotal connection and the distance between one pair of second support elements 204 at ends thereof that are distant from the pivotal connection is greater than that at the pivotal connection, thereby setting the pallet in a contracted condition for carrying and supporting cargo of a smaller size; when the support members 20 at the two ends of the main extension member 10 are moved away from each other, the auxiliary extension members 30 push the two support members 20 away from each other to provide an effect of assisting restoration of the pallet for setting the pallet in a non-contracted condition.

In the instant embodiment, the number of the auxiliary extension members 30 involved is plural and the auxiliary extension members 30 are symmetrically arranged on two opposite sides of the main extension member 10. Further, the lengths of the auxiliary extension members 30 that are located closer to the main extension member 10 is getting closer to the length of the main extension member 10 during the contraction process of the pallet in order to allow the support members 20 to bend or curve about the pivotal connection between the first support element 202 and the second support element 204 to reduce the size of the pallet for carrying and supporting cargo of a small size.

Figure 8:
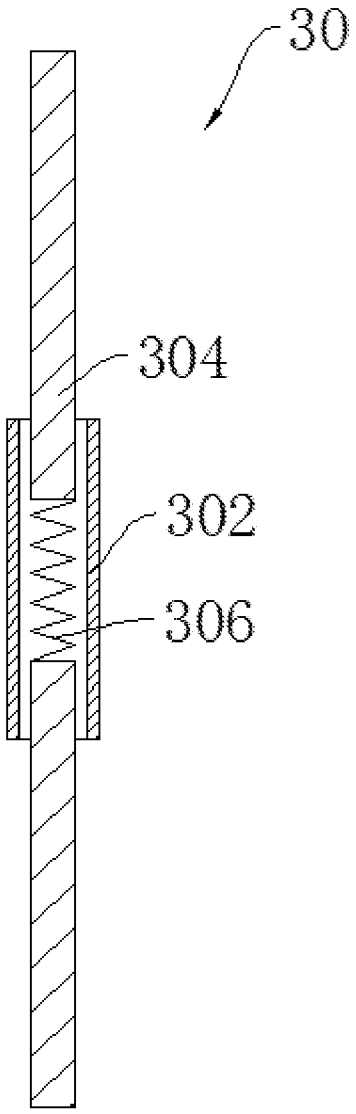
FIG. 8 is a schematic view illustrating a cross-section of an auxiliary extension member of the pallet provided in the second embodiment of the present invention.

In the instant embodiment, reference being made in combination with FIG. 8, the auxiliary extension members 30 each comprise a pair of straight bars 304 and a sleeve 302 that is fit over the pair of straight bars 304. The pair of straight bars 304 are connected to each other through an elastic member 306. Ends of the straight bars 304 that are distant from the sleeve 302 are respectively pivoted to the support members 20. Further, the elastic member 306 is kept in a compressed state in order to constantly set the pair of straight bars 304, under the action of the elastic member 108, in a condition of being biased toward directions of separating from each other thereby providing an effect of assistive retention and support of the support members 20 at the two ends of the main extension member 10.

Rotation of the rotary sleeve 102 allows for adjustment of the distance between the pair of threaded bars 104 and varies the length of the main extension member 10. The two ends of the main extension member 10 are each connected to one of the support members 20. Each of the support members 20 comprises a first support element 202 and a second support element 204 pivoted to each other. The main extension member 10 is connected to the pivotal connection between the first support element 202 and the second support element 204. Thus, adjusting the length of the main extension member 10 changes the bending or inclining condition between the first support element 202 and the second support element 204 so as to change the size of the pallet, allowing for flexible variation of the size of the pallet to suit the need for transportation of cargo of different sizes and thus reducing costs of transportation and storage.

The present invention has been described with reference to the preferred embodiments. However, it is noted that those skilled in the art would appreciates that various improvements and modifications are still available without departing from the scope of the present invention and such improvements and modifications are considered within the scope of protection of the present invention.

What is claimed is:

1. A pallet, comprising main extension members and support members, wherein the main extension members each comprise a rotary sleeve and a pair of threaded bars, the pair of threaded bars being respectively inserted into the rotary sleeve through two ends of the rotary sleeve, the threaded bars and the rotary sleeve being connected in a rotatable manner through threading engagement therebetween, the support members each comprising a first support element and a second support element pivoted to each other, an end of each of the threaded bars that is distant from the rotary sleeve being pivotally connected to the pivotal connection between the first support element and the second support element corresponding thereto such that rotation of the rotary sleeve adjusts a distance between the pair of threaded bars to change a relative bending condition between the first support element and the second support element thereby varying a size of the pallet.

2. The pallet as claimed in claim 1, wherein the number of the main extension members is two and the two main extension members are arranged to intersect each other, each of the main extension members being connected to one pair of the support members, and wherein when the pallet is in a non-contracted condition, two pairs of the support members collectively define a circumferentially enclosed configuration.

3. The pallet as claimed in claim 2, wherein the pallet further comprises auxiliary extension members, the auxiliary extension members being arranged one pair of the support members connected to the main extension members, the auxiliary extension members each having two ends respectively pivoted to one pair of the first support elements or one pair of the second support elements.

4. The pallet as claimed in claim 3, wherein the number of the auxiliary extension members is plural and the auxiliary extension members are symmetrically arranged on two opposite sides of the main extension members.

5. The pallet as claimed in claim 4, wherein the auxiliary extension members each comprise one pair of straight bars and a sleeve fit over the pair of straight bars, the pair of straight bars being connected to each other through an elastic member, the straight bars having ends distant from the sleeve being pivoted to the support members.

6. The pallet as claimed in claim 1, wherein an end of the first support element connected to the second support element is provided with a first rotation axle, and an end of the second support element connected to the first support element is provided with a second rotation axle that is hollowed, the second rotation axle being fit over the first rotation axle, the first rotation axle having an outer circumferential surface on which a plurality of projections are formed, the second rotation axle having an inner circumferential surface in which a plurality of recesses is formed, the projections and the recesses being engageable with each other to selectively set and fix a relative position between the first support element and the second support element.

7. The pallet as claimed in claim 6, wherein the number of the main extension members is two and the two main extension members are arranged to intersect each other, each of the main extension members being connected to one pair of the support members, and wherein when the pallet is in a non-contracted condition, two pairs of the support members collectively define a circumferentially enclosed configuration.

8. The pallet as claimed in claim 7, wherein the pallet further comprises auxiliary extension members, the auxiliary extension members being arranged one pair of the support members connected to the main extension members, the auxiliary extension members each having two ends respectively pivoted to one pair of the first support elements or one pair of the second support elements.

9. The pallet as claimed in claim 8, wherein the number of the auxiliary extension members is plural and the auxiliary extension members are symmetrically arranged on two opposite sides of the main extension members.

10. The pallet as claimed in claim 1, wherein the main extension members each further comprise an elastic member, the elastic member being received in the rotary sleeve, the pair of threaded bars being connected to each other by the elastic member.

11. The pallet as claimed in claim 10, wherein the number of the main extension members is two and the two main extension members are arranged to intersect each other, each of the main extension members being connected to one pair of the support members, and wherein when the pallet is in a non-contracted condition, two pairs of the support members collectively define a circumferentially enclosed configuration.

12. The pallet as claimed in claim 11, wherein the pallet further comprises auxiliary extension members, the auxiliary extension members being arranged one pair of the support members connected to the main extension members, the auxiliary extension members each having two ends respectively pivoted to one pair of the first support elements or one pair of the second support elements.

13. The pallet as claimed in claim 12, wherein the number of the auxiliary extension members is plural and the auxiliary extension members are symmetrically arranged on two opposite sides of the main extension members.

14. The pallet as claimed in claim 1, wherein the rotary sleeve has an inner wall that is provided with at least two threaded plugs, the threaded plugs being fixed to the inner wall of the rotary sleeve, the threaded bars being respectively inserted into the threaded plugs and forming threading engagement with the threaded plugs.

15. The pallet as claimed in claim 14, wherein the number of the main extension members is two and the two main extension members are arranged to intersect each other, each of the main extension members being connected to one pair of the support members, and wherein when the pallet is in a non-contracted condition, two pairs of the support members collectively define a circumferentially enclosed configuration.

16. The pallet as claimed in claim 15, wherein the pallet further comprises auxiliary extension members, the auxiliary extension members being arranged one pair of the support members connected to the main extension members, the auxiliary extension members each having two ends respectively pivoted to one pair of the first support elements or one pair of the second support elements.

17. The pallet as claimed in claim 16, wherein the number of the auxiliary extension members is plural and the auxiliary extension members are symmetrically arranged on two opposite sides of the main extension members.

18. The pallet as claimed in claim 1, wherein the threaded bars are each of a hollowed structure to reduce weight of the pallet.

19. The pallet as claimed in claim 1, wherein the support members each comprise a first layer and a second layer fixedly connected to each other, the first layer and the second layer being stacked on each other such that a gap is formed between the first layer and the second layer for receiving insertion of a fork of a forklift.

* * * * *